US012428198B2

(12) United States Patent
O'Donnell

(10) Patent No.: US 12,428,198 B2
(45) Date of Patent: Sep. 30, 2025

(54) BEVERAGE CONTAINERS WITH ADJUSTABLE INDICATORS FOR CONTENTS

(71) Applicant: 6Buttons LLC, Canton, GA (US)

(72) Inventor: Rory O'Donnell, Canton, GA (US)

(73) Assignee: 6Buttons LLC, Canton, GA (US)

( * ) Notice: Subject to any disclaimer, the term of this patent is extended or adjusted under 35 U.S.C. 154(b) by 74 days.

(21) Appl. No.: 18/346,597

(22) Filed: Jul. 3, 2023

(65) Prior Publication Data

US 2024/0002105 A1 Jan. 4, 2024

Related U.S. Application Data

(60) Provisional application No. 63/367,514, filed on Jul. 1, 2022.

(51) Int. Cl.

| | |
|---|---|
| ***B65D 23/08*** | (2006.01) |
| ***B65D 23/14*** | (2006.01) |
| ***B65D 25/20*** | (2006.01) |
| ***B65D 51/24*** | (2006.01) |
| *A47G 19/22* | (2006.01) |

(52) U.S. Cl.

CPC ..... *B65D 25/20* (2013.01); *B65D 23/08* (2013.01); *B65D 23/14* (2013.01); *A47G 19/2227* (2013.01); *B65D 51/24* (2013.01); *B65D 2203/12* (2013.01)

(58) Field of Classification Search

CPC ..... A47G 19/2227; A47G 19/2272; A47G 23/0216; A45F 3/16–18; B65D 23/0871; B65D 25/20; B65D 23/08; B65D 23/205; B65D 23/14; G06F 23/08

USPC ..... 206/459.1

See application file for complete search history.

(56) References Cited

U.S. PATENT DOCUMENTS

| | | | | | |
|---|---|---|---|---|---|
| 1,397,079 | A * | 11/1921 | Cohen | G09F 3/18 | 40/665 |
| 1,649,442 | A * | 11/1927 | Bredemeier | B65D 25/02 | 283/106 |
| 3,787,993 | A * | 1/1974 | Lyon | G09F 3/00 | 40/310 |
| 3,818,858 | A * | 6/1974 | Kramer | A47J 47/02 | D7/629 |
| 5,992,073 | A * | 11/1999 | Wolpa | G09F 7/10 | 40/306 |
| 6,250,545 | B1 * | 6/2001 | Mazzarolo | B65D 81/3876 | 220/737 |

(Continued)

FOREIGN PATENT DOCUMENTS

| | | | | |
|---|---|---|---|---|
| CA | 3021177 | A1 * | 5/2019 | B65D 23/003 |

*Primary Examiner* — Mollie Impink

(74) *Attorney, Agent, or Firm* — Greenberg Traurig, LLP

(57) ABSTRACT

A container for storing a beverage includes a vessel for storing the beverage, a lid removably attachable to the vessel, and a sleeve attached to an exterior of the vessel. The sleeve is moveable between a first position and second position with respect to the vessel. The sleeve includes a first visual indicator of contents of the vessel, and the exterior of the vessel includes a second visual indicator of the contents. While the sleeve is in the first position, the first visual indicator is visible and the second visual indicator is not visible. While the sleeve is in the second position, both the first visual indicator and the second visual indicator are visible.

14 Claims, 16 Drawing Sheets

(56) References Cited

U.S. PATENT DOCUMENTS

| | | | | |
|---|---|---|---|---|
| 7,172,668 | B2 * | 2/2007 | Key | B65C 9/20 206/774 |
| 8,231,001 | B2 * | 7/2012 | Boon | B65D 25/205 206/459.1 |
| 8,500,022 | B2 * | 8/2013 | Kidwell | B65D 5/38 40/310 |
| 8,640,870 | B2 * | 2/2014 | Ruman | B65D 5/62 206/440 |
| 8,657,288 | B2 * | 2/2014 | Fletcher | A63F 9/1044 446/124 |
| 10,492,996 | B1 * | 12/2019 | Winter | A61J 7/0076 |
| 10,506,826 | B2 * | 12/2019 | Lynch | A24F 47/00 |
| 2003/0230019 | A1 * | 12/2003 | Olivera | G09F 3/00 40/310 |
| 2004/0195254 | A1 * | 10/2004 | Bunkers | G09F 23/08 220/739 |
| 2004/0205989 | A1 * | 10/2004 | Michaels | G09F 23/08 40/310 |
| 2009/0015000 | A1 * | 1/2009 | Wolfe | G09F 3/16 206/459.5 |
| 2009/0095645 | A1 * | 4/2009 | Lopez | A47G 23/16 206/217 |
| 2010/0038273 | A1 * | 2/2010 | Johnson | B01L 3/508 53/473 |
| 2010/0170819 | A1 * | 7/2010 | Skinner | G09F 23/06 206/459.5 |
| 2011/0062173 | A1 * | 3/2011 | Trotter | B65D 1/265 220/780 |
| 2012/0055964 | A1 * | 3/2012 | Gluck | A47G 19/2227 224/267 |
| 2013/0233872 | A1 * | 9/2013 | Tessier | B65D 81/365 220/737 |

* cited by examiner

BEVERAGE CONTAINERS WITH ADJUSTABLE INDICATORS FOR CONTENTS

CROSS-REFERENCE TO RELATED APPLICATION

This application claims priority to U.S. Provisional Application No. 63/367,514 filed on Jul. 1, 2022 and entitled "BEVERAGE CONTAINERS WITH ADJUSTABLE INDICATORS FOR CONTENTS," the entire contents of which is hereby incorporated by reference in their entireties.

BACKGROUND

Various types of containers are used to store food products such as solid food and beverages. In order for the food products stored in a container to be identifiable, containers are often designed to be partially or fully transparent. Similarly, containers may also have labels affixed thereto in order to identify the food products stored therein.

SUMMARY

In an embodiment, a container for storing a beverage includes a vessel for storing the beverage, a lid removably attachable to the vessel, and a sleeve attached to an exterior of the vessel. The sleeve is moveable between a first position and second position with respect to the vessel. The sleeve includes a first visual indicator of contents of the vessel, and the exterior of the vessel includes a second visual indicator of the contents. While the sleeve is in the first position, the first visual indicator is visible and the second visual indicator is not visible. While the sleeve is in the second position, both the first visual indicator and the second visual indicator are visible.

In an embodiment, a container for storing a food product includes a vessel for storing the food product and a moveable panel attachable to an exterior of the vessel. The moveable panel is moveable between a first position and second position with respect to the vessel. While the moveable panel is in the first position, the visual indicator is not visible on the vessel. While the moveable panel is in the second position, a visual indicator configured to indicate a type of food product in the container is visible.

DETAILED DESCRIPTION

Figure 1:
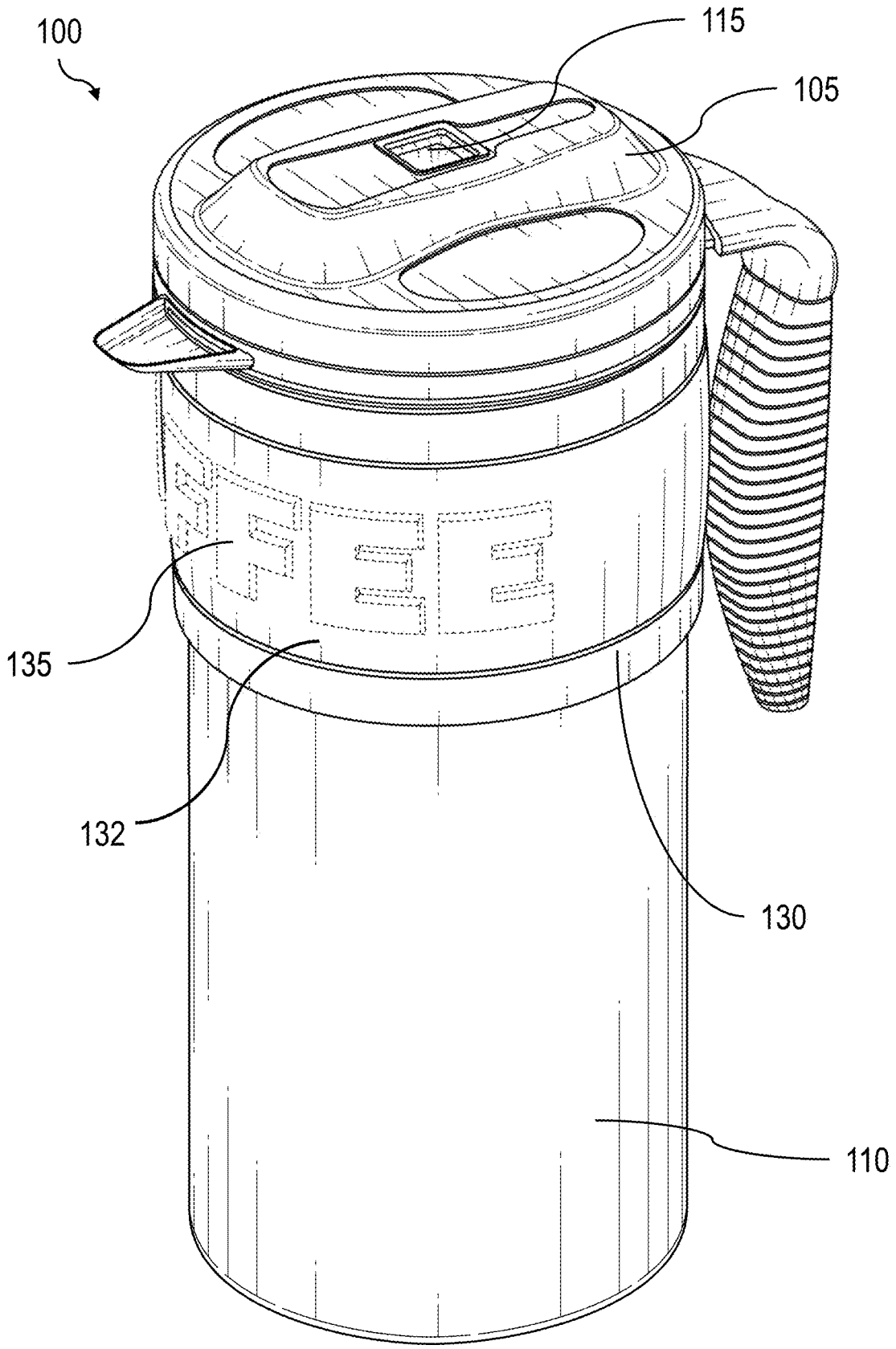
FIG. 1 is a first perspective view of a beverage container in a first configuration in accordance with an illustrative embodiment.

Described herein are various embodiments of containers or vessels for storing food or any other products or items. The terms container and vessel may be used interchangeably herein. The containers described herein may advantageously have ways to indicate on the containers various aspects related to the contents stored therein. As just one example, a restaurant may brew different types of coffee, and it may be desirable for the containers in which the coffee is brewed to indicate what type of coffee has been placed therein.

Prior coffee pots may include different colored rims designed to indicate a type of coffee placed therein (e.g., decaf or regular). However, those colored rims are permanently affixed to the coffee pot, so employees of a restaurant must still ensure that the proper type of coffee is placed in a pot with a given colored rim. In addition, a pot with a given rim color must be used for the type of coffee it indicates. As such, there is both the opportunity for an employee to make a mistake by placing the wrong type of coffee in a pot and inflexibility of the coffee pots, as the coffee pots can only be used for a single type of coffee brewed.

The various embodiments described herein provide for improved vessels for storing food products of different types, as the vessels may include markers or other indicators thereon that are adjustable to indicate different types of food products therein. In this way, an employee at a restaurant, for example, can brew any type of coffee in a given coffee pot and adjust the indicator(s) on the coffee pot to indicate the type of coffee actually brewed. This provides more flexible vessels that can be used for more than one type of food product and provides for adjustable indicators on the vessel.

A further advantage of the indicators described herein is that they may be permanently or semi-permanently attached to the vessel for storing a food product. For example, an indicator may be movably attached to a vessel so that it may move between two positions that are indicative of a type of food product stored in the vessel. In this way, the indicator is less likely to get lost than an indicator that is only placed on a vessel to indicate a first type of food product and removed when that first type of food product is not inside the vessel.

In various embodiments, products or items other than food products may be stored inside the various example vessels described herein. For example, any of coffee, soup, juice, tea, lemonade, water, bulk goods, ingredients, or any other beverage or food product may be stored in the vessels described herein. As additional examples, toys, clothes, office supplies, tools, hardware, computer/circuit parts, components for manufacturing a larger product, cosmetics/toiletries, or any other non-food product may be stored in the vessels with varying indicators as described herein. As such, the embodiments described herein may relate to storing food products, but are not limited thereto.

FIGS. 1-16 of the application show an example embodiment of a coffee pot vessel with indicators for different types of coffee stored therein. In FIGS. 1-8, the indicator is shown in a first position where a coffee indicator is visible, but a second indicator (e.g., decal) is not visible, while in FIGS. 9-16, the indicator or sleeve is shown in a second position so that the first coffee indicator and the second decaf indicator are both visible. The embodiment of FIGS. 1-16 is discussed at greater length below. However, various other embodiments with indicators for representing a type of food product and other information are contemplated herein, and the example embodiment of FIGS. 1-16 should not be construed to limit those other embodiments.

Figure 2:
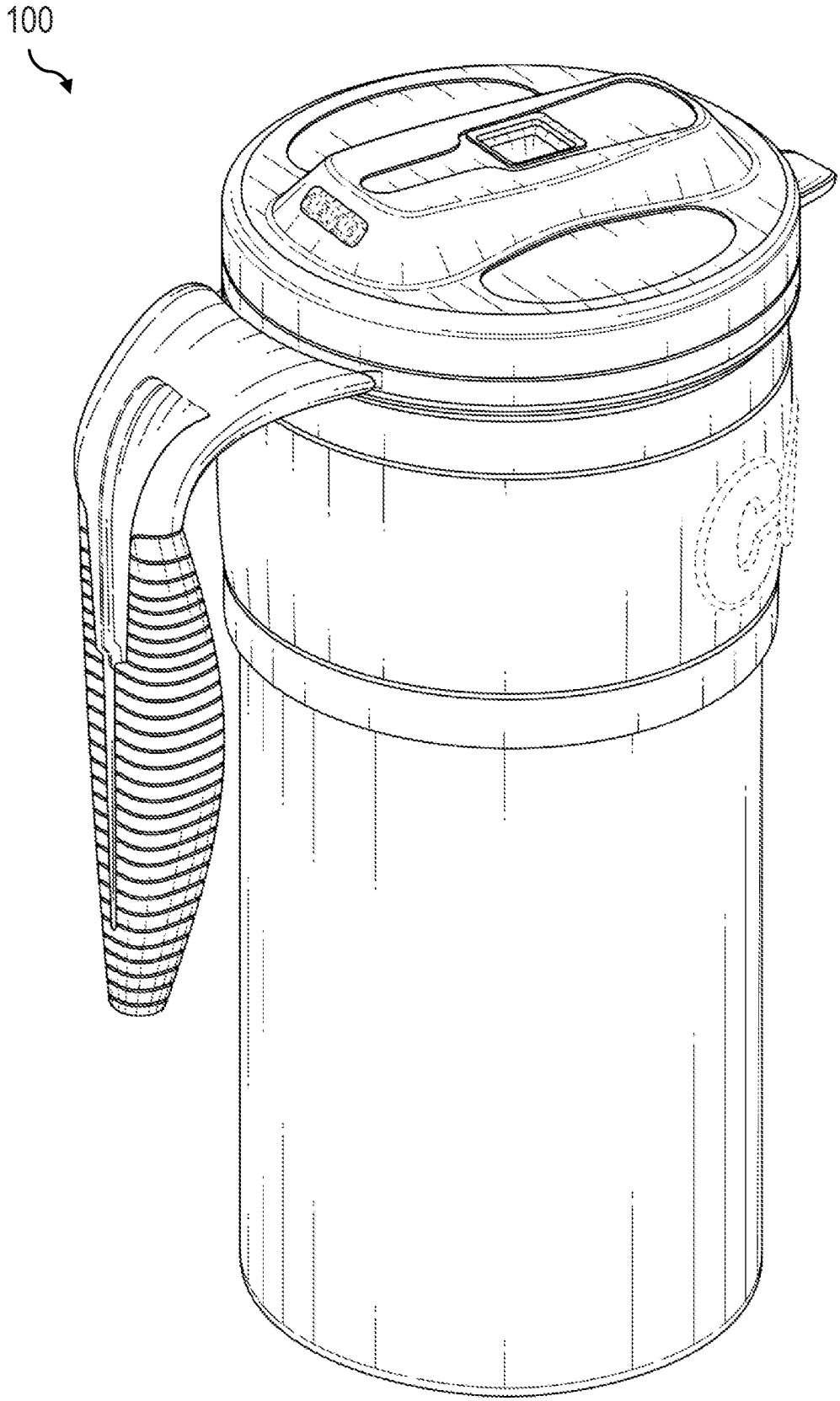
FIG. 2 is a second perspective view of the beverage container of FIG. 1.
Figure 3:
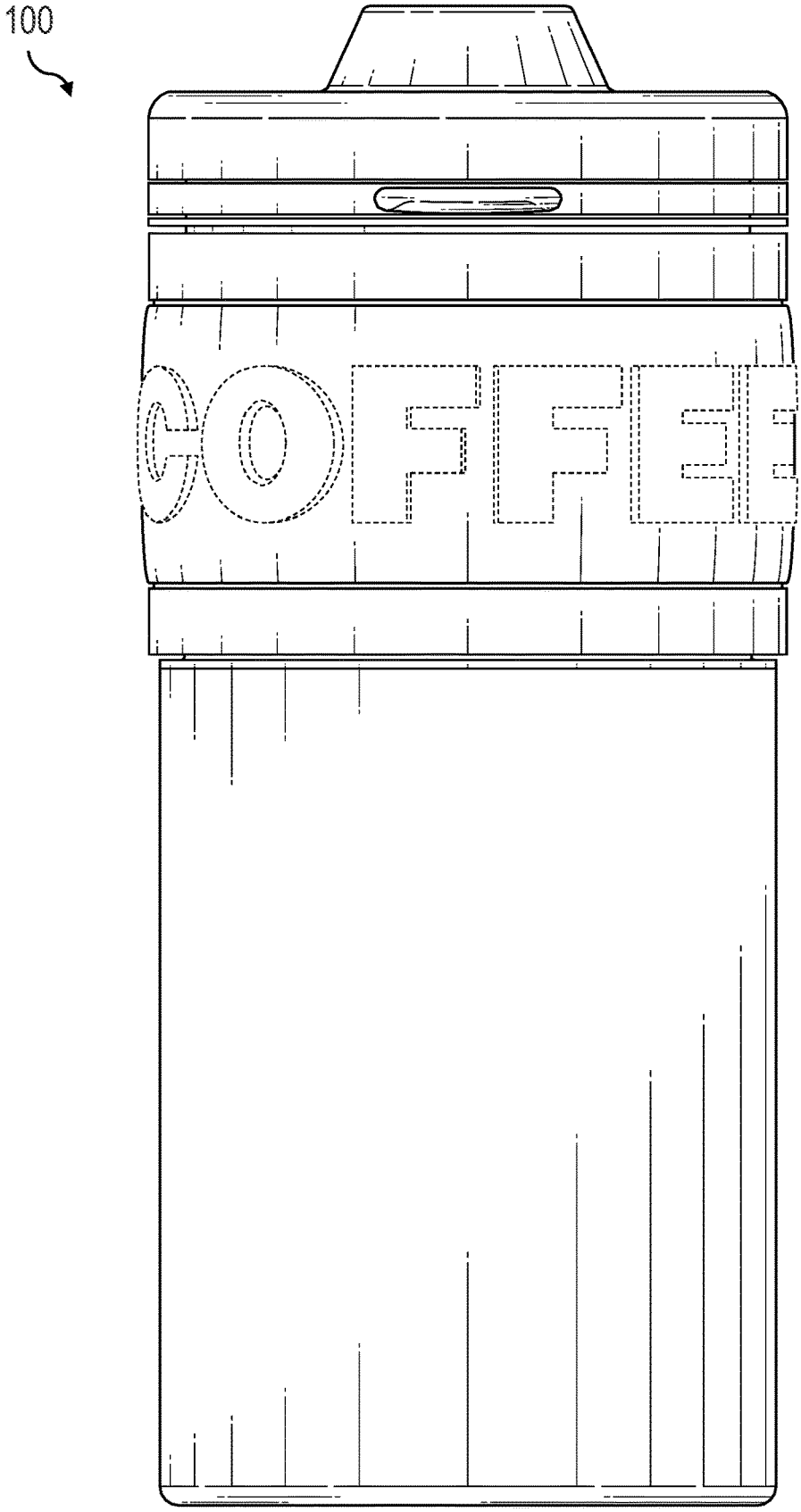
FIG. 3 is a front elevational view of the beverage container of FIG. 1.
Figure 4:
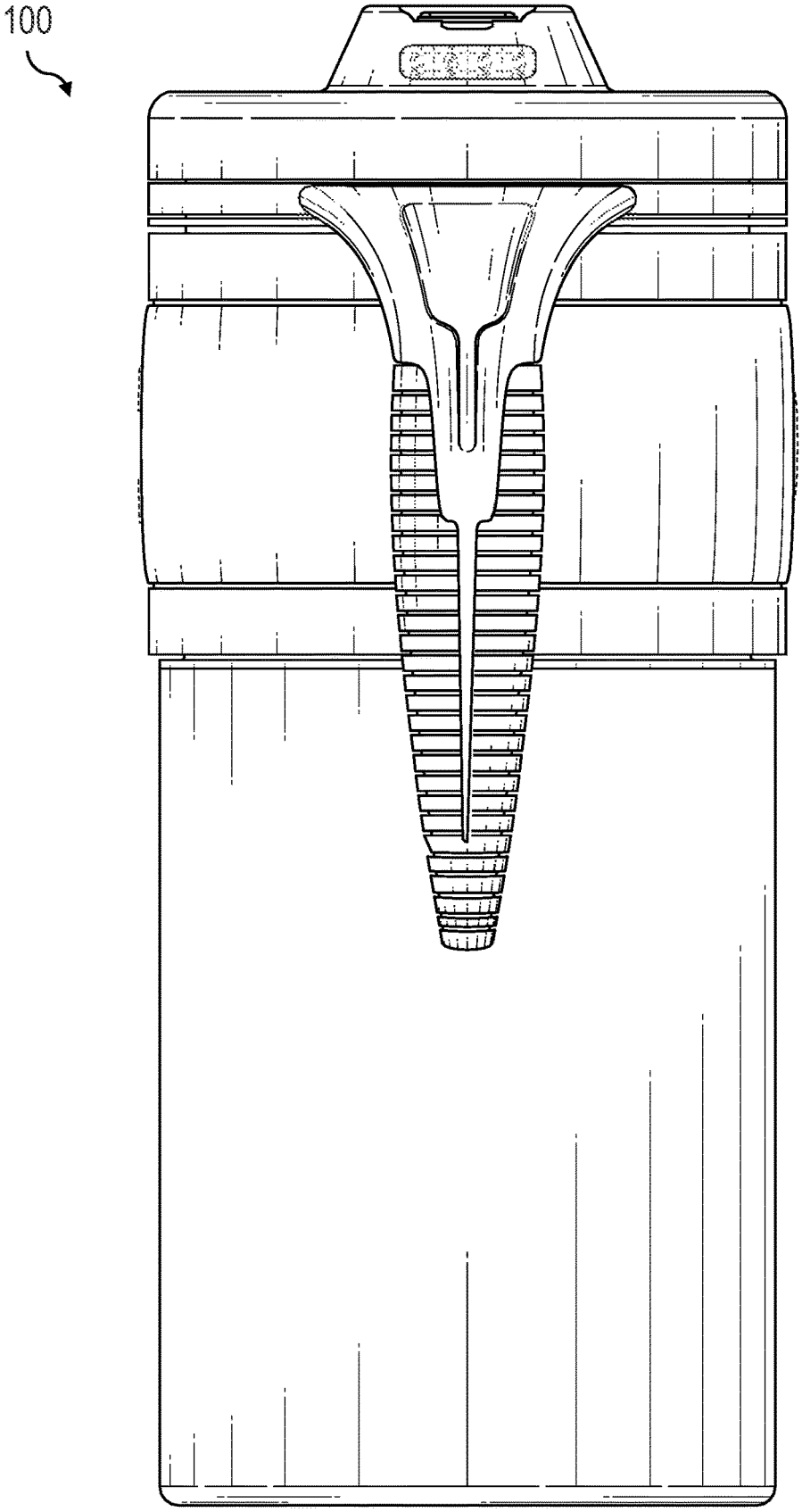
FIG. 4 is a rear elevational view of the beverage container of FIG. 1.
Figure 5:
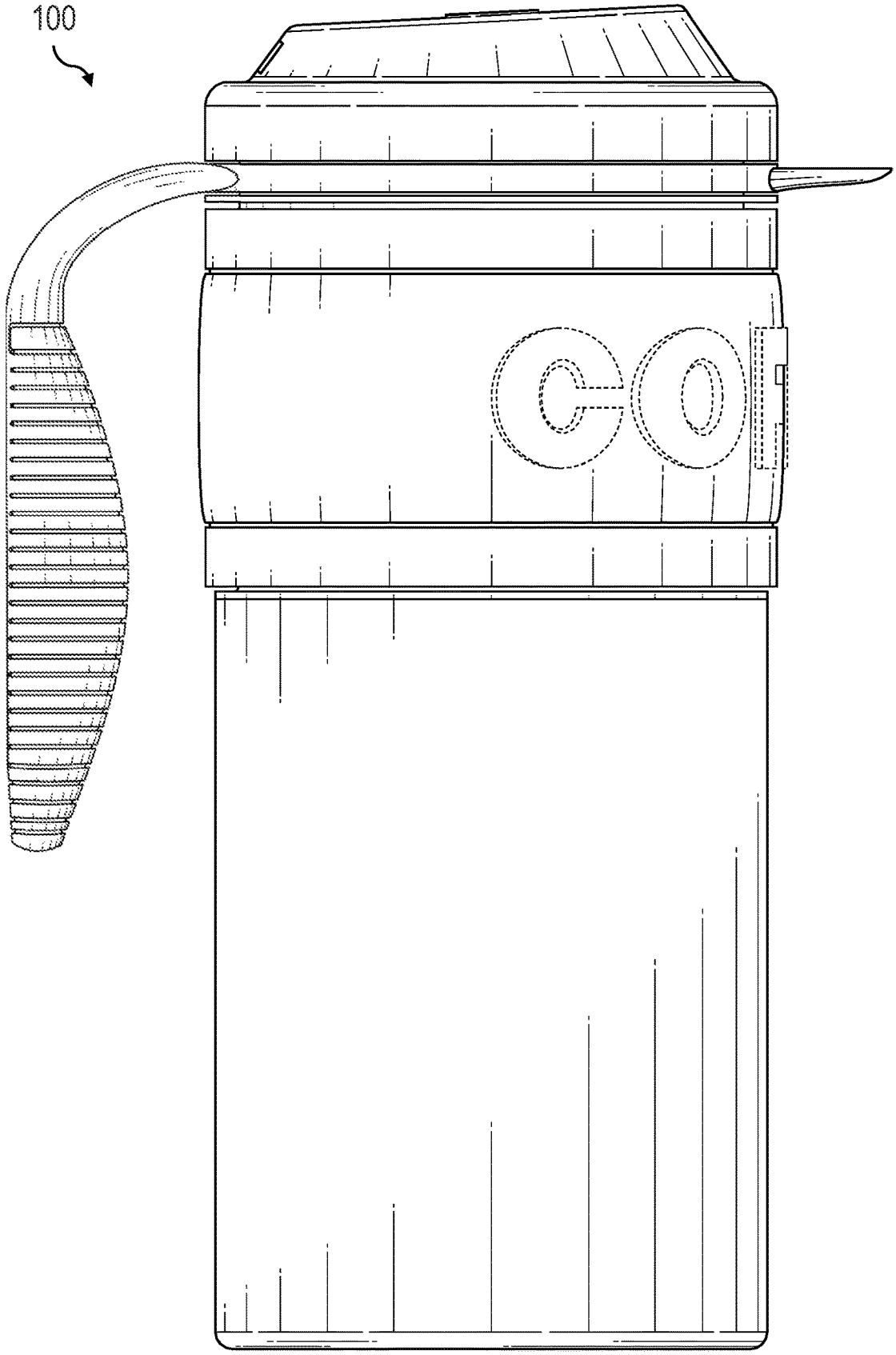
FIG. 5 is a left side elevational view of the beverage container of FIG. 1.
Figure 6:
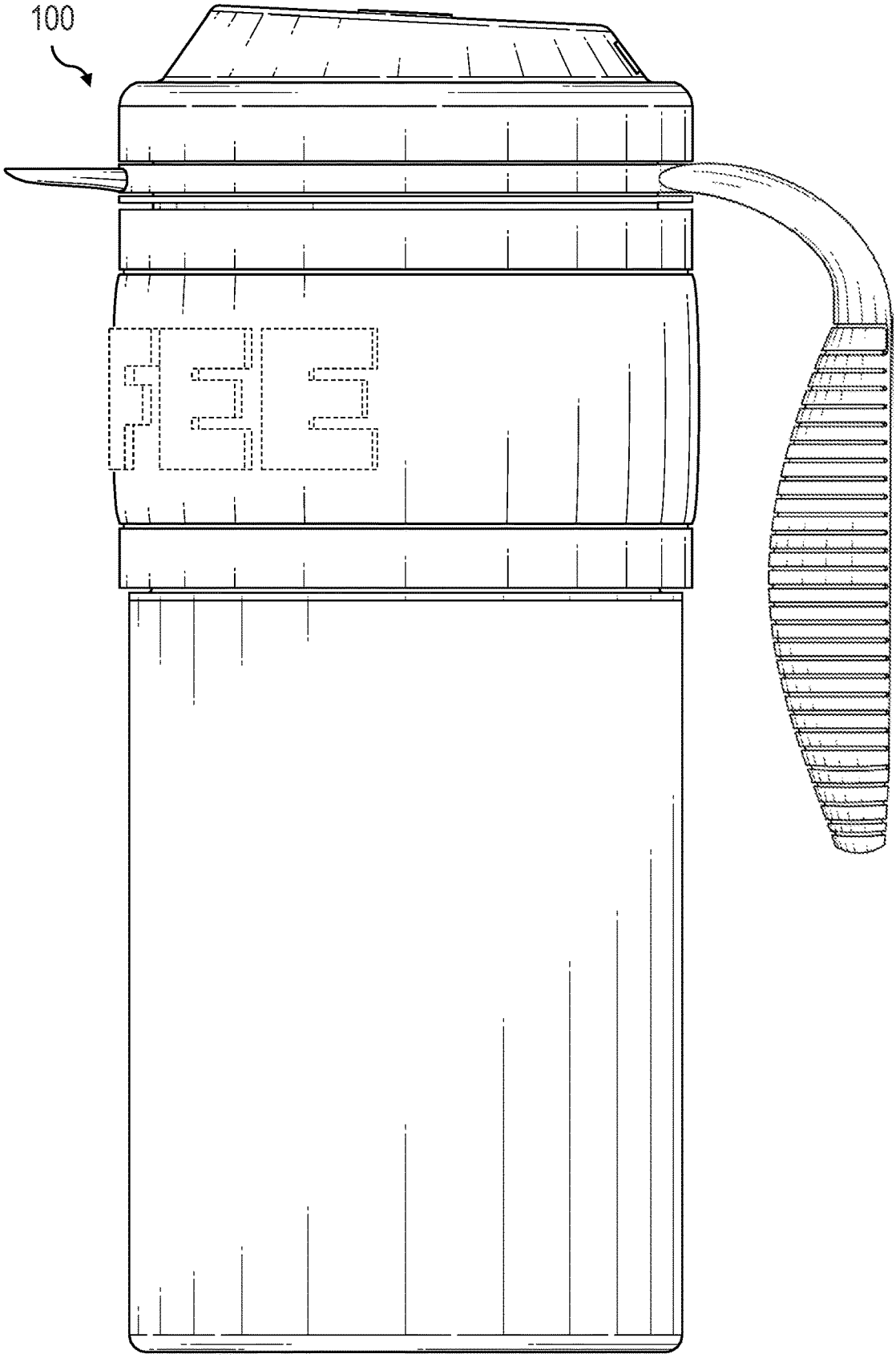
FIG. 6 is a right side elevational view of the beverage container of FIG. 1.
Figure 7:
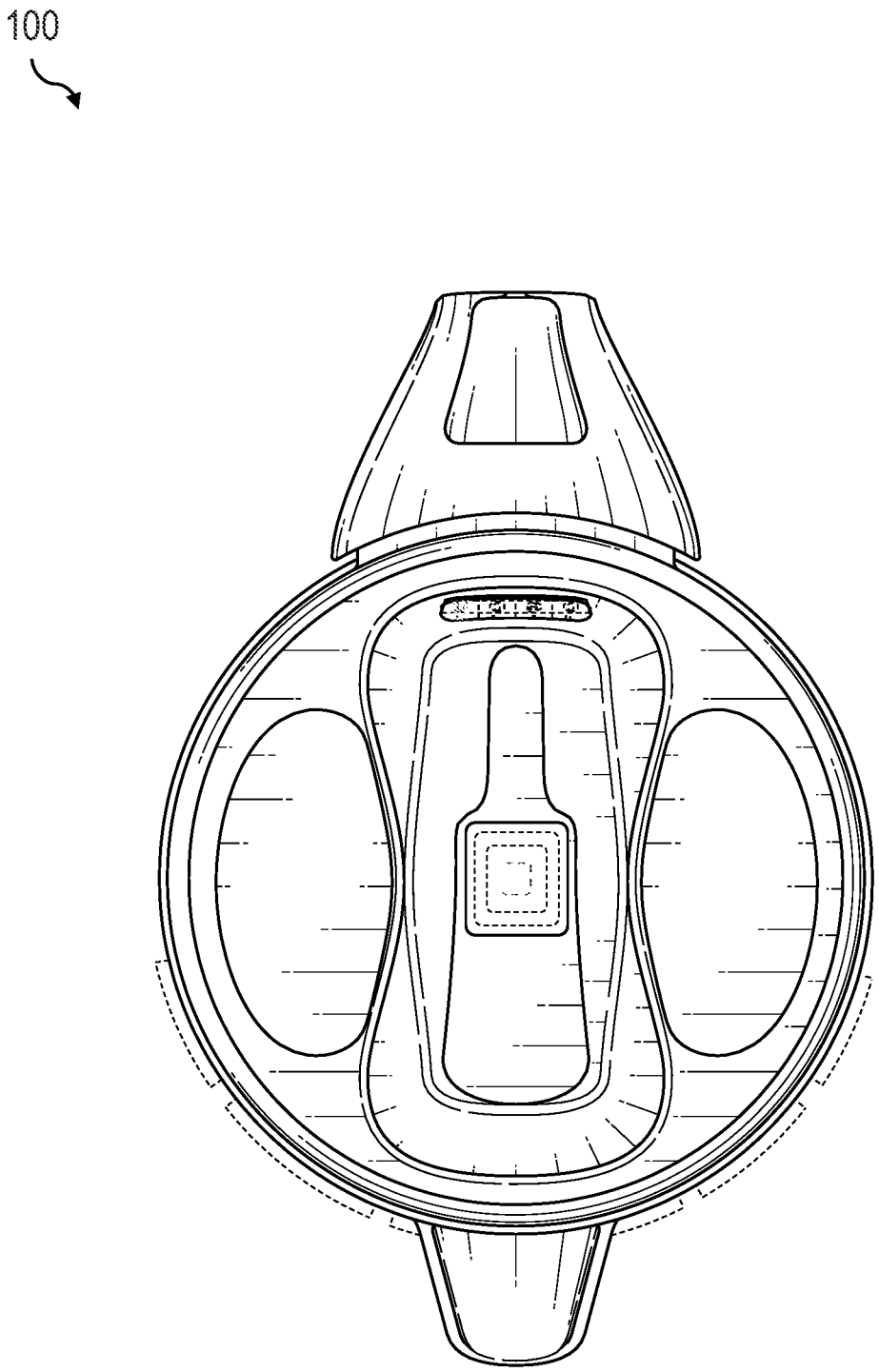
FIG. 7 is a top plan view of the beverage container of FIG. 1.
Figure 8:
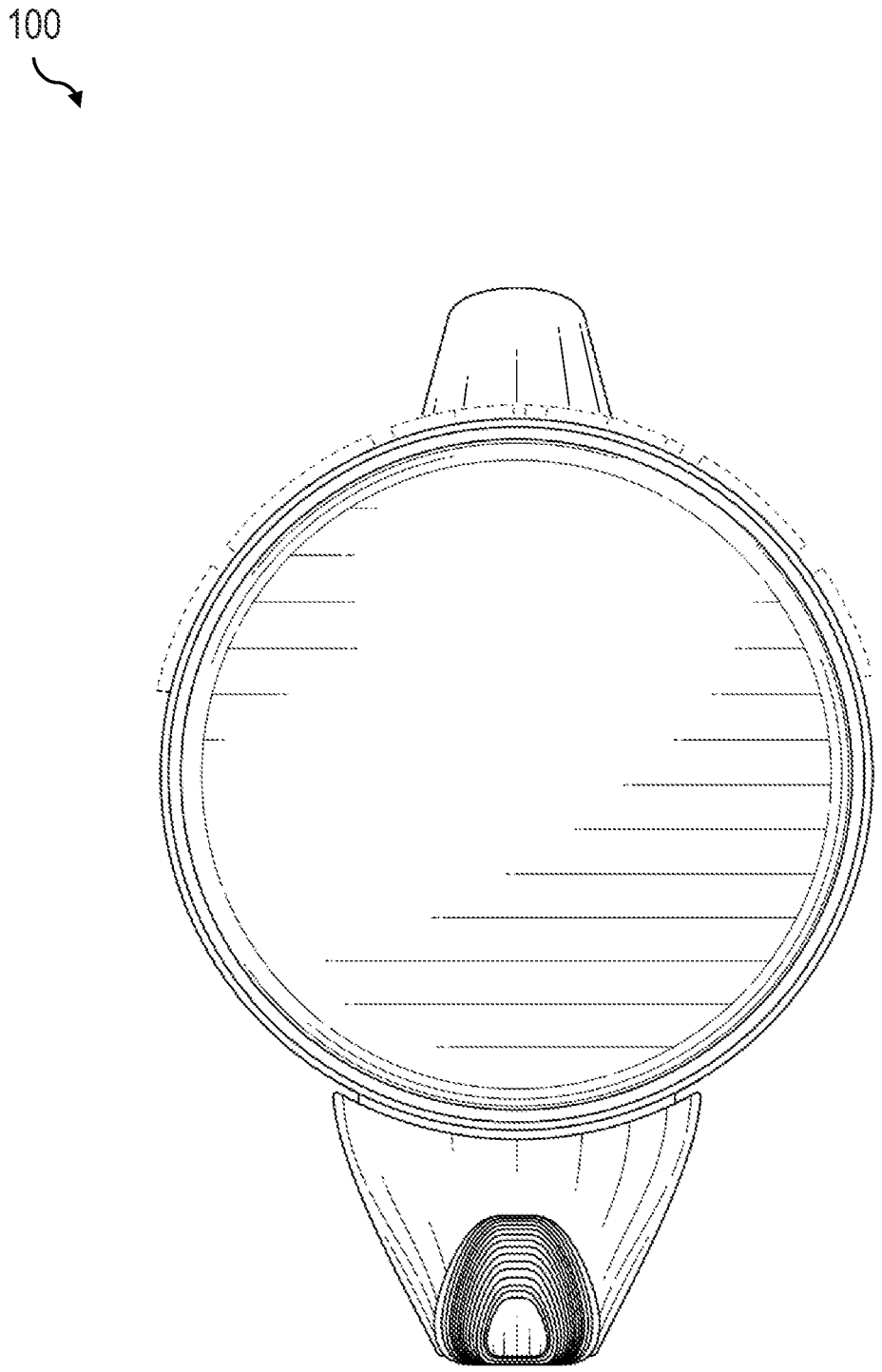
FIG. 8 is a bottom plan view of the beverage container of FIG. 1.
Figure 9:
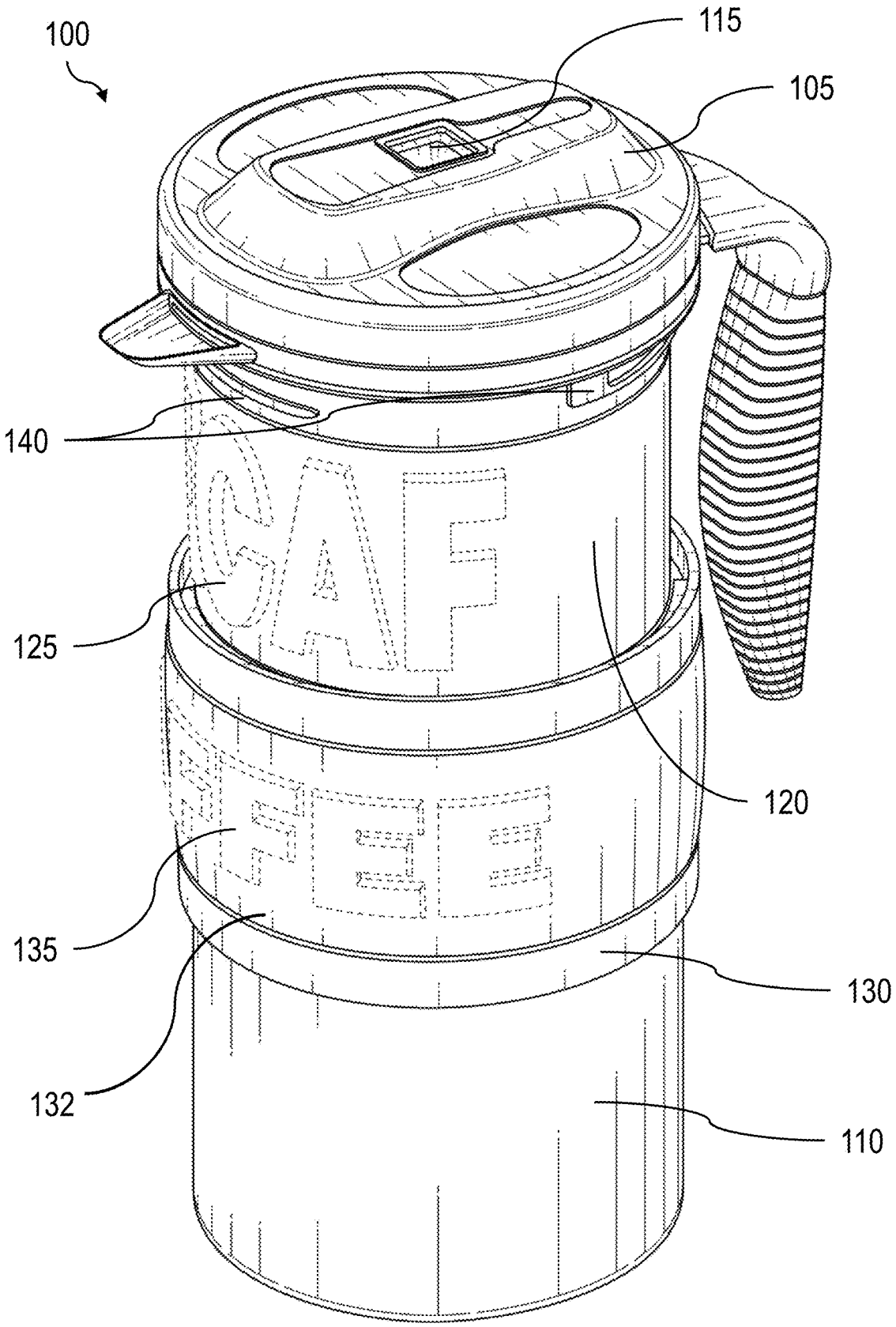
FIG. 9 is a first perspective view of the beverage container of FIG. 1 in a second configuration in accordance with an illustrative embodiment.

In particular, with respect to FIGS. 1-8, FIG. 1 is a first perspective view of a beverage container in a first configuration; FIG. 2 is a second perspective view of the beverage container of FIG. 1; FIG. 3 is a front elevational view of the beverage container of FIG. 1; FIG. 4 is a rear elevational view of the beverage container of FIG. 1; FIG. 5 is a left side elevational view of the beverage container of FIG. 1; FIG. 6 is a right side elevational view of the beverage container of FIG. 1; FIG. 7 is a top plan view of the beverage container of FIG. 1; and FIG. 8 is a bottom plan view of the beverage container of FIG. 1.

Figure 10:
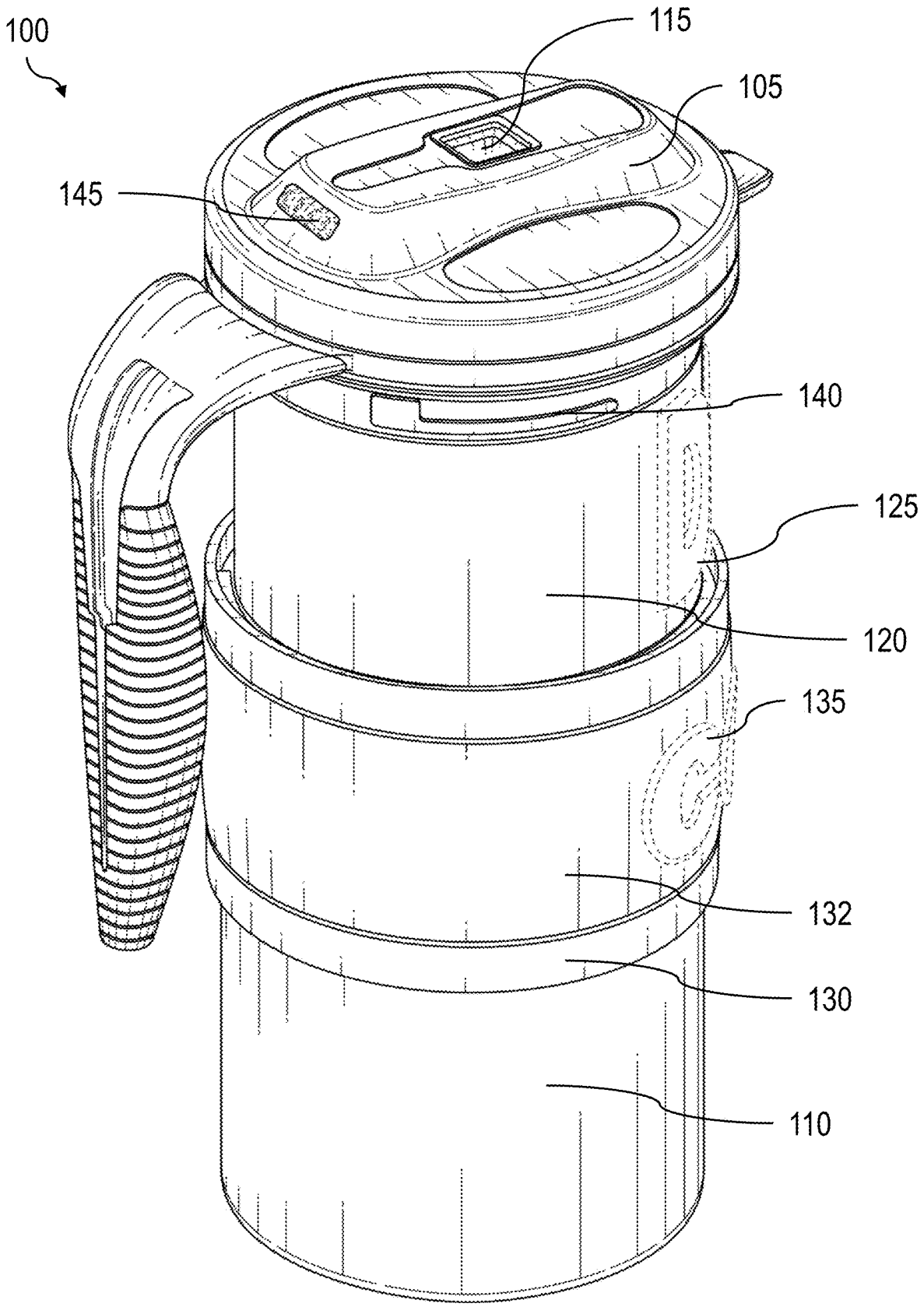
FIG. 10 is a second perspective view of the beverage container of FIG. 9.
Figure 11:
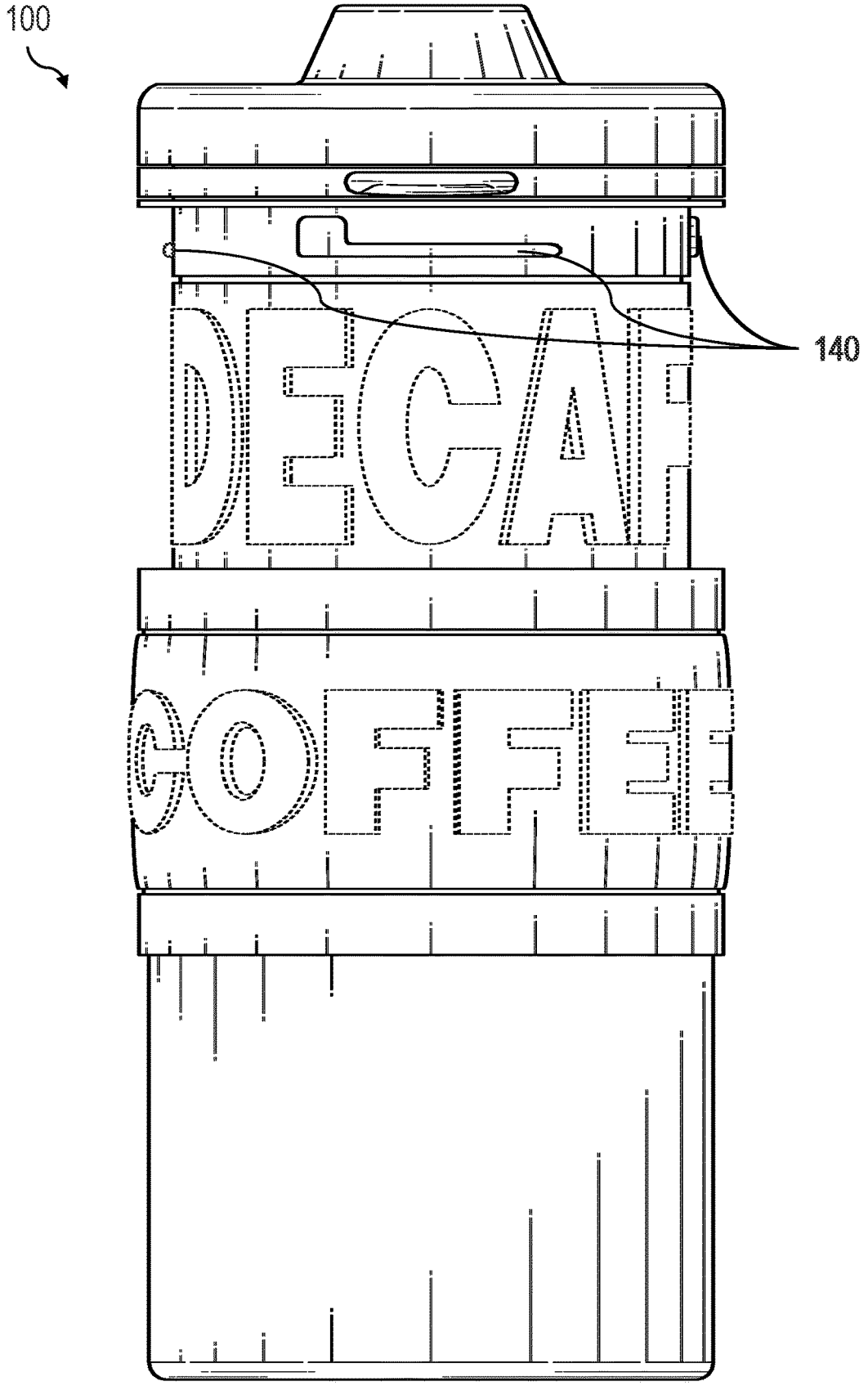
FIG. 11 is a front elevational view of the beverage container of FIG. 9.
Figure 12:
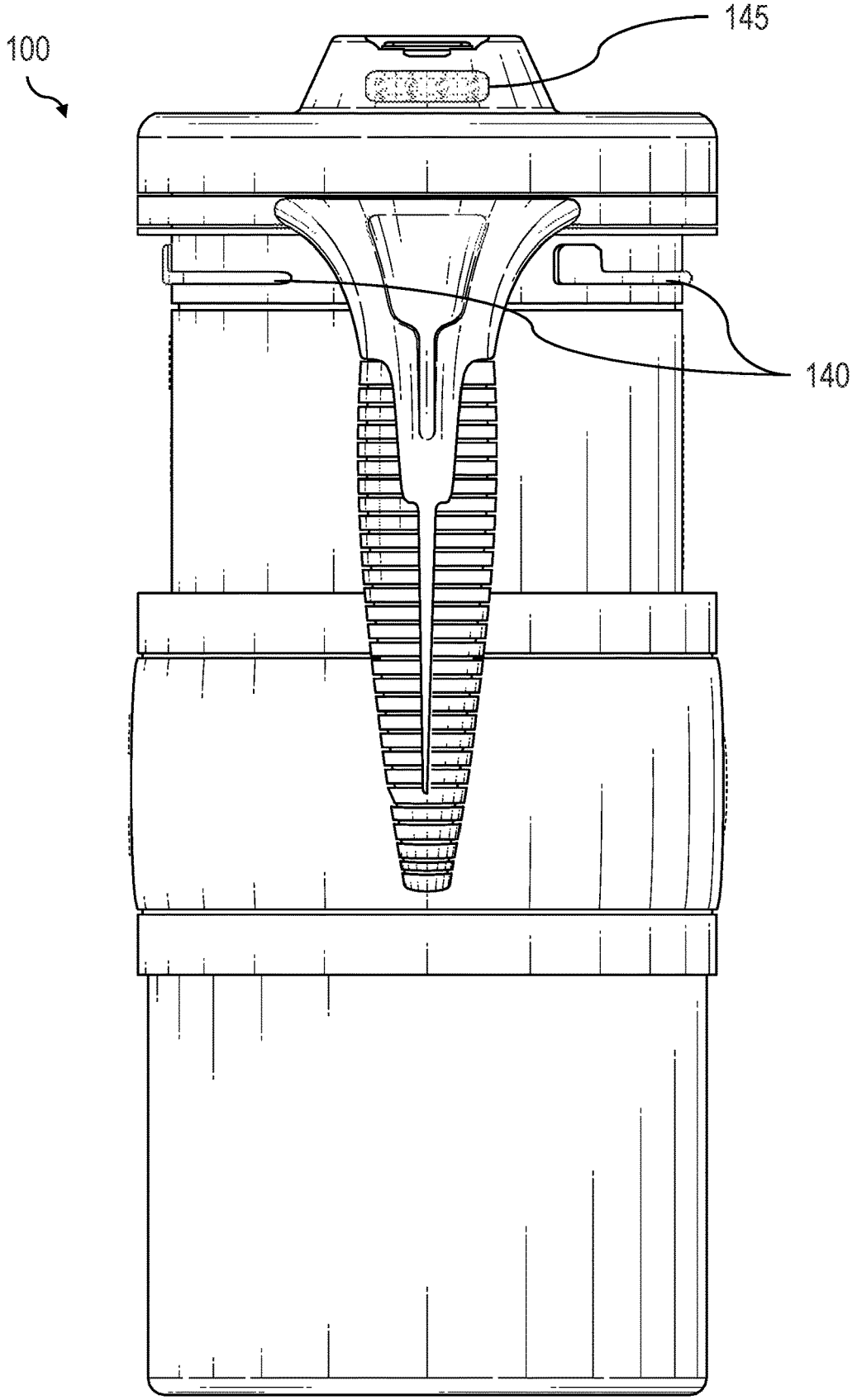
FIG. 12 is a rear elevational view of the beverage container of FIG. 9.
Figure 13:
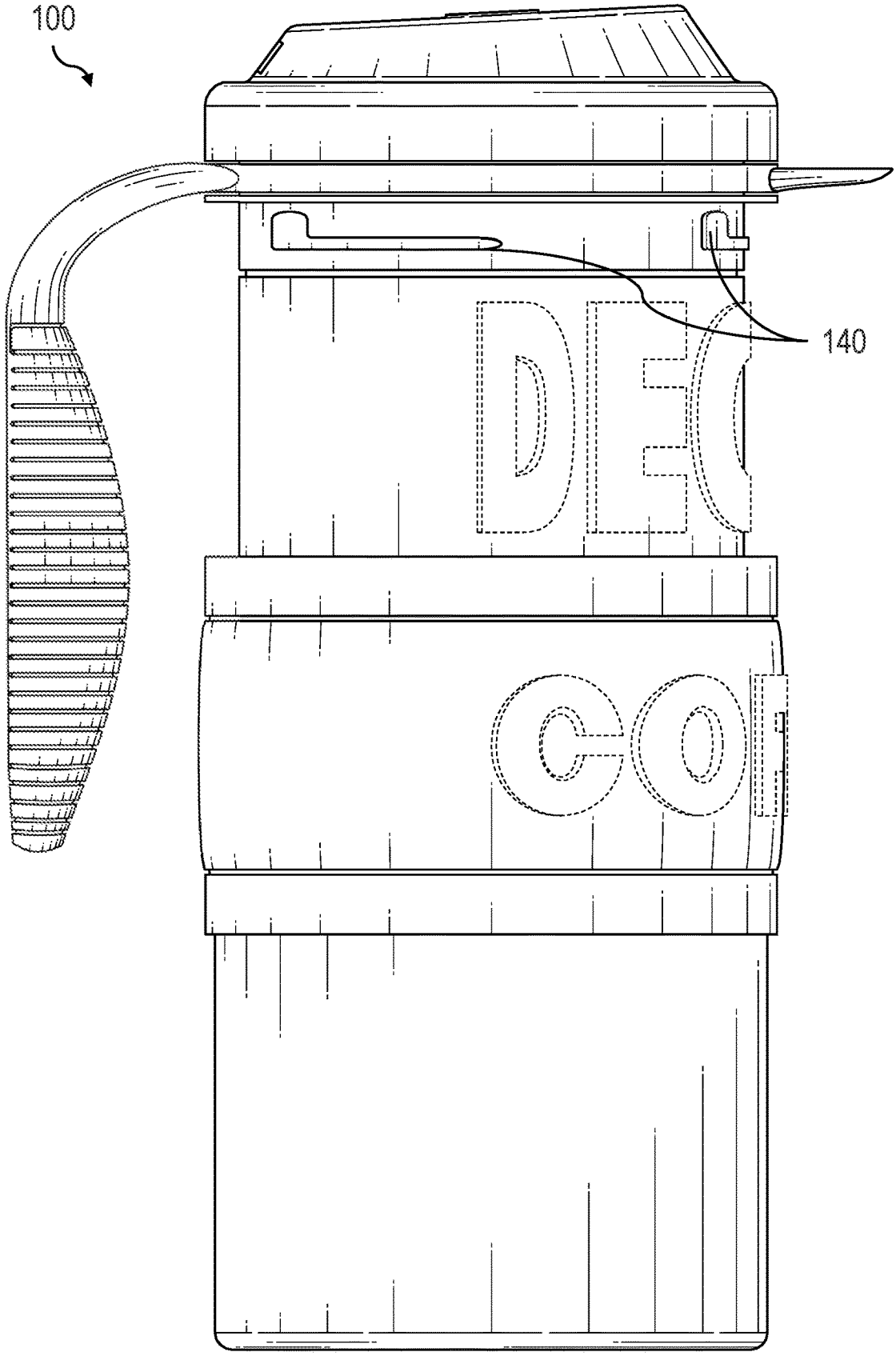
FIG. 13 is a left side elevational view of the beverage container of FIG. 9.
Figure 14:
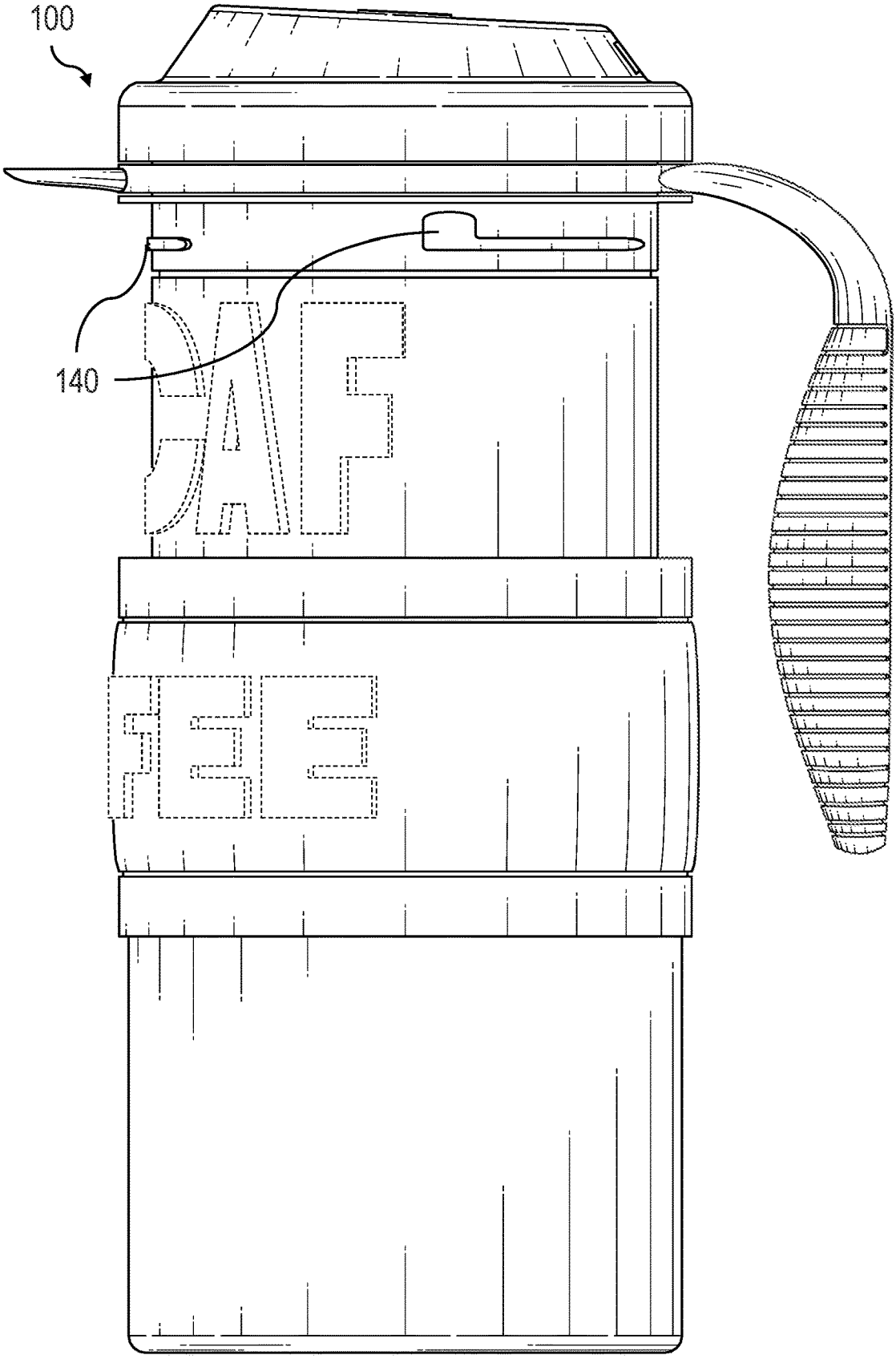
FIG. 14 is a right side elevational view of the beverage container of FIG. 9.
Figure 15:
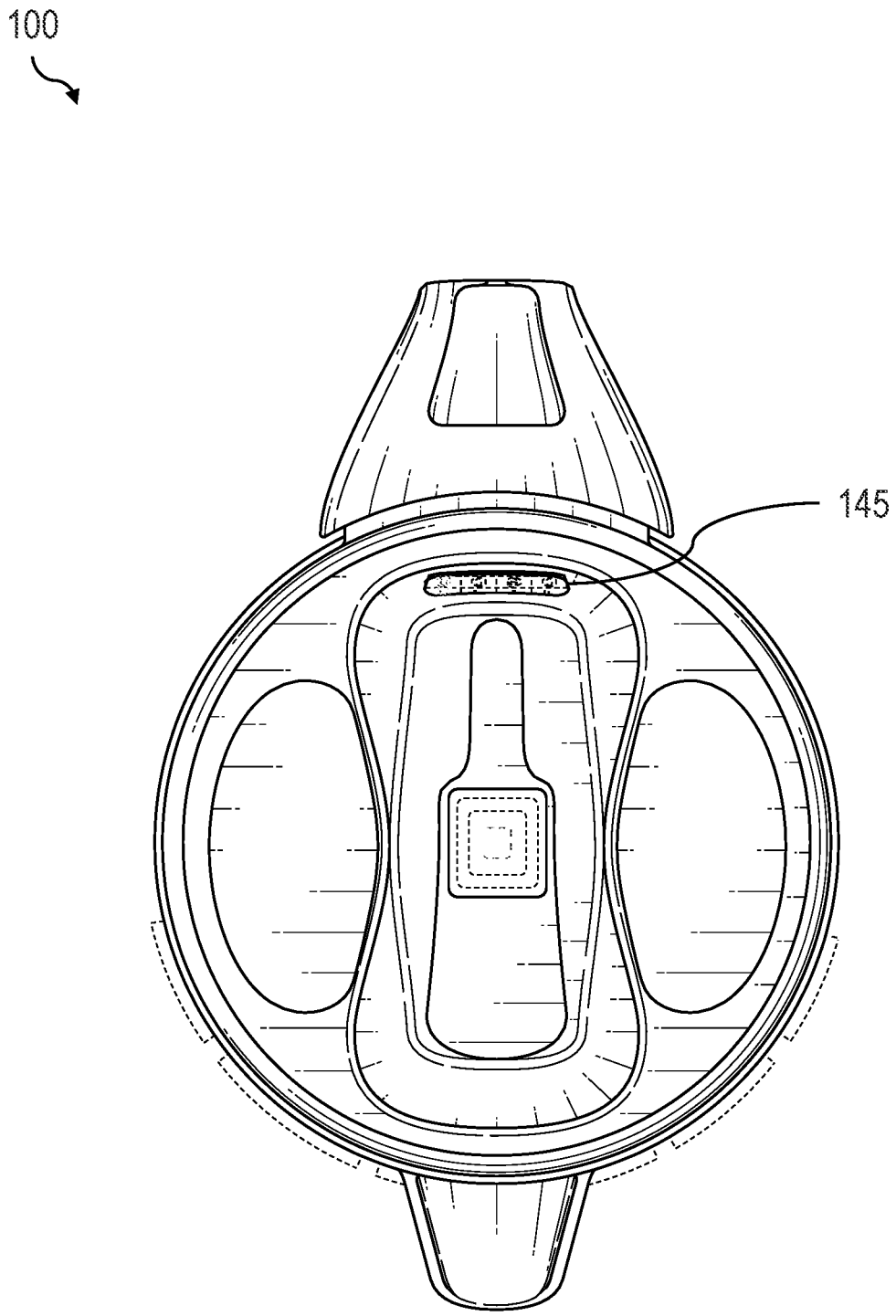
FIG. 15 is a top plan view of the beverage container of FIG. 9.
Figure 16:
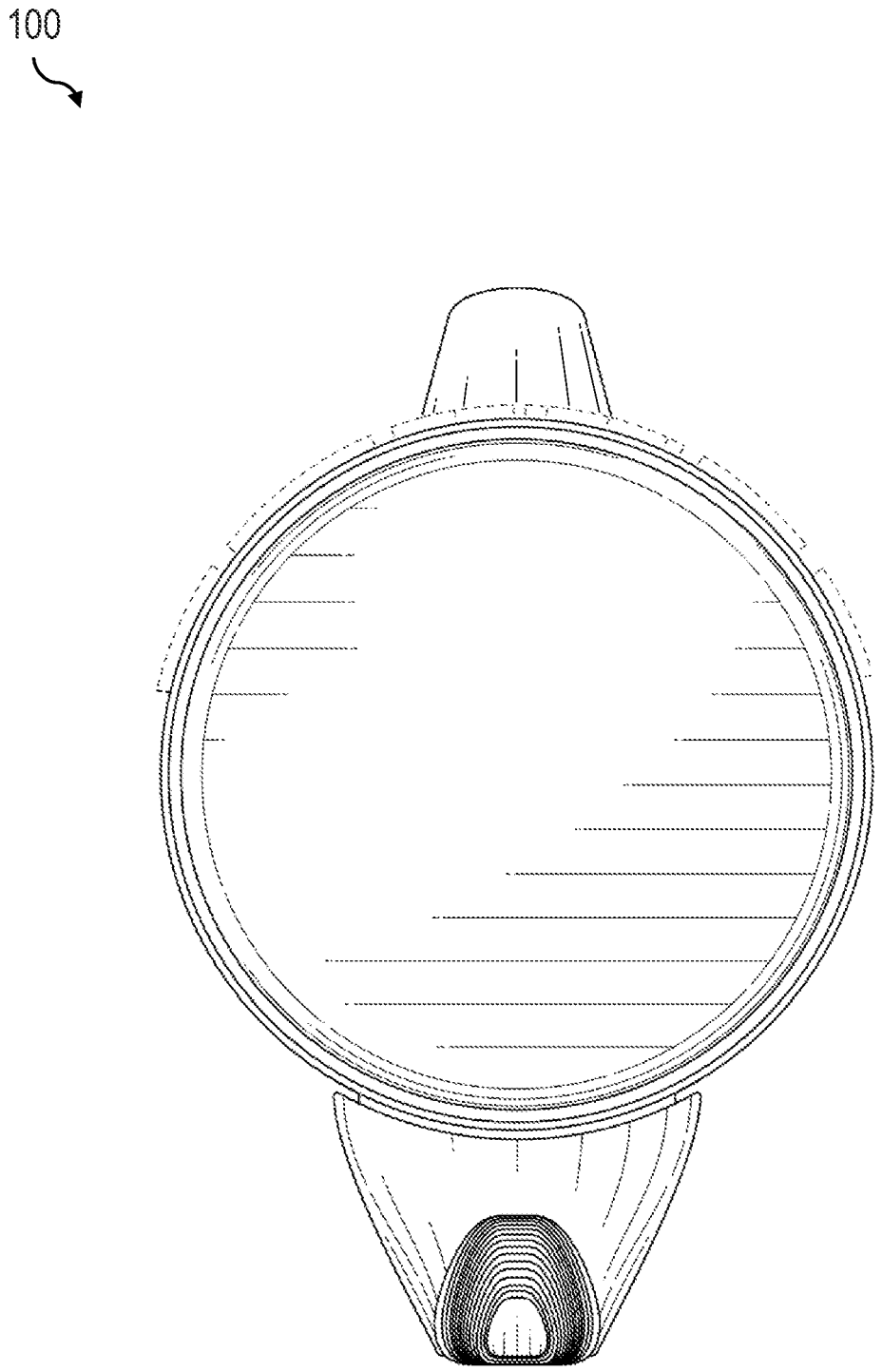
FIG. 16 is a bottom plan view of the beverage container of FIG. 9.

With respect to FIGS. 9-16, FIG. 9 is a first perspective view of the beverage container of FIG. 1 in a second configuration; FIG. 10 is a second perspective view of the beverage container of FIG. 9; FIG. 11 is a front elevational view of the beverage container of FIG. 9; FIG. 12 is a rear elevational view of the beverage container of FIG. 9; FIG. 13 is a left side elevational view of the beverage container of FIG. 9; FIG. 14 is a right side elevational view of the beverage container of FIG. 9; FIG. 15 is a top plan view of the beverage container of FIG. 9; and FIG. 16 is a bottom plan view of the beverage container of FIG. 9.

In FIGS. 1-16, a container 100 for storing a beverage is shown. The container 100 may include a vessel 110 that stores a food product, such as a beverage (e.g., coffee, juice, milk, water, etc.). A lid 105 is removably attachable to the vessel. The lid 105 may be removable from the vessel 110 so that the vessel 110 and lid 105 may be more easily cleaned, so that food product may be quickly added to or removed from the vessel 110, etc. The lid 105 may also have an opening 115 through which food product may be added to the vessel 110. For example, the container 100 may be placed in or under a coffee maker, and the coffee may drip into the opening 115 as the coffee maker brews the coffee. In this way, the coffee may pass through the opening 115 in the lid 105 and into the vessel 110.

A sleeve 130 may further be attached to an exterior of the vessel 110. The sleeve 130 may include a first visual indicator 135 of contents of the vessel 110. For example, in FIGS. 1-16, the first visual indicator 135 reads "COFFEE." However, in various embodiments, the first visual indicator may be any indicator of a food product in the vessel 110 or other information related to the container 100 or the food product stored therein. The exterior of the vessel 110 may further include a second visual indicator 125 of the contents of the vessel 110. In the example of FIGS. 9-16, the second visual indicator 125 reads "DECAF."

The sleeve 130 may be moveable between a first position and second position with respect to the vessel 110. FIGS. 1-8 show the sleeve 130 in the first position and FIGS. 9-16 show the sleeve 130 in the second position. As such, while the sleeve 130 is in the first position, the first visual indicator 135 is visible and the second visual indicator 125 is not visible. While the sleeve 130 is in the second position, both the first visual indicator 135 and the second visual indicator 125 are visible. As such, while the sleeve 130 is in the second position, the entire vessel 110 may read "DECAF COFFEE," and in the first position the entire vessel 110 may read just "COFFEE." In this way, a person brewing coffee, for example at a restaurant, can adjust the sleeve based on the type of coffee being brewed and placed in the container 100. Then, anyone who subsequently uses the container 100 before brewing a new pot of coffee may know what type of coffee is in the container 100 (e.g., regular coffee or decaf coffee).

In various embodiments, the first and second visual indicators may be any other type of indicators and may indicate different types of coffee or other food products. As such, the embodiments described herein may be used for other food products than just coffee. In various embodiments, the container 100 may also have additional, fewer, and/or different indicators than those shown in FIGS. 1-16. In various embodiments, the sleeve 130 or other movable component may also be movable between more than two positions.

In various embodiments, the sleeve 130 and the vessel 110 may interact mechanically to lock the sleeve 130 into place in one or both of the first position and the, wherein the sleeve and the vessel are configured to mechanically interlock with one another in at least one of the first position or the second position. In this way, the sleeve 130 may lock into place to prevent the sleeve 130 from inadvertently being moved between positions.

For example, the exterior of the vessel 110 may include at least one first physical feature 140 configured to mechanically interlock with at least one second physical feature (not visible) of the sleeve. The second physical feature may be one or more tabs toward the top of the sleeve 130 and extending inward from an inner surface of the sleeve 130 toward an exterior of the vessel 110. The tabs may be movable as the sleeve 130 is moved, so that the tabs may move above a lower portion of the first physical feature 140 and slide across that lower portion as the sleeve 130 is rotated, such that the tab abuts a taller portion of the first physical feature 140 to lock the sleeve 130 into the first position.

In the example of FIGS. 1-16 the sleeve 130 would be rotated clockwise to lock the sleeve 130 to the vessel 110 using the first and second physical features of the vessel 110 and sleeve 130, respectively. Similarly, in order to unlock the sleeve 130 from the vessel 100, the sleeve 130 may rotated (e.g., counterclockwise in the example of FIGS. 1-16) such that the tab(s) of the sleeve 130 no longer interfere with the first physical features 140, allowing the sleeve 130 to move back down into its second position. In various embodiments, there may be locking mechanism for the second position as well. In various embodiments, no locking mechanism may be used for the second position, as gravity may hold the sleeve 130 in the second position. In various embodiments, any other type of locking and/or interference fit mechanisms may be used to lock a moveable component of a container into one or more positions such that one or more indicators of a product in a container is visible or not visible as desired.

In various embodiments, the sleeve 130 or a portion of the sleeve 130 may also removable from the vessel 110. In various other embodiments, the sleeve 130 or a portion of the sleeve 130 may not be removable from the vessel 110. For example, the sleeve 130 may include a band 132 on which the indicator 135 is located. The band 132 may be formed from rubber, silicone, or another stretchable material so that the band 132 may be removed from the sleeve 135. In this way, the band 132 may be interchangeable with other bands that have different types of indicators on them. Similarly, the indicator 125 may be removable or permanently affixed to the vessel 110. For example, the indicator 125 may also be on a band 120 that may be removable from the vessel 110, and therefore interchangeable with other bands that have differing indicators thereon. In other words, one or both of the sleeve 130 and/or a band 132 on the sleeve 130 may be removable from the vessel 110 so that the indicators on the sleeve 130 or other movable component may be changed as desired. Similarly, the indicator 125 may be removable from the vessel 110 so that the indicator 125 may also be changed as desired. Accordingly, either of the visual indicators shown in the embodiments of FIGS. 1-16 may be interchangeable with third, fourth, etc. indicators so that the vessel 110 may be customizable to any degree desired to hold different types of substances, food products, etc.

Another advantage of the embodiments described herein is that the lid 105 may be removable form the vessel while the sleeve is in any of the first position or the second position. In other words, the lid can be removed and replaced without affecting the position of the sleeve, and bands placed thereon, etc.

The container 100 may further include a third visual indicator 145 configured to indicate an approximate time and/or date in which a food product such as a beverage was placed in the container 100. For example, the third visual indicator 145 may be located on the lid 105, the vessel 110, the sleeve 130, etc. In the example shown in FIGS. 1-16, the third visual indicator 145 is located on the lid 105. The third visual indicator 145 may include a plurality of wheels that manually rotate based on interaction with a user to display different numbers. For example, four different wheels may be used so that a time may be displayed, such as an approximate time at which a pot of coffee stored in the container 100 was brewed. The third visual indicator 145 may further have indicators for any or all of day of the week, calendar date, month, year, etc. In this way, a date or day of preparation, day a food product must be disposed of, etc. may be indicated. While the embodiment of FIGS. 1-16 show the third visual indicator in the lid 105, the third visual indicator 145 may be located at any other location on the container 100, and/or there may be multiple visual indicators similar to the third visual indicator 145 so that different types of information may be indicated at different places on the container 100.

Although in FIGS. 1-16 the moveable portion of the container 100 is shown as the sleeve 130, other types of moveable panels or components are contemplated and may be used in different embodiments. For example, a rectangular panel fixed to the front of the container 100 within a channel may be used, and different indicators behind the panel on the exterior of the vessel 110 may be revealed or hidden based on the position of the rectangular panel. Such panels, like the sleeve 130 or a band 132 affixed thereto, may be removable in various embodiments so that different types of indicators may be placed on a container.

As FIGS. 1-16 show merely one embodiment of the various features described herein, the embodiment shown in FIGS. 1-16 depict merely one ornamental design in which features described herein may be implemented. In such an ornamental design, for example, the "DECAF" and "COFFEE" lettering is shown in broken lines, as the wording or lettering of the container/vessel may be different in different ornamental designs.

The foregoing description of illustrative embodiments has been presented for purposes of illustration and of description. It is not intended to be exhaustive or limiting with respect to the precise form disclosed, and modifications and variations are possible in light of the above teachings or from practice of the disclosed embodiments. It is intended that the scope of the invention be defined by the claims appended hereto and their equivalents.

What is claimed is:

1. A container for storing a beverage comprising:
a vessel for storing the beverage;
a lid removably attachable to a top of the vessel; and
a sleeve attached to an exterior of the vessel,
wherein:
the sleeve is not removable from the vessel,
the sleeve is moveable between a first position and second position with respect to the vessel,
the first position is closer to the top of the vessel than the second position,
the sleeve comprises a first visual indicator of contents of the vessel,
the exterior of the vessel comprises a second visual indicator of the contents,
while the sleeve is in the first position, the first visual indicator is visible and the second visual indicator is not visible, and
while the sleeve is in the second position, both the first visual indicator and the second visual indicator are visible.

2. The container of claim 1, wherein the first visual indicator comprises the word coffee.

3. The container of claim 2, wherein the second visual indicator comprises the word decaf.

4. The container of claim 1, wherein the sleeve and the vessel are configured to mechanically interlock with one another in at least one of the first position or the second position.

5. The container of claim 1, wherein the exterior of the vessel comprises at least one first physical feature configured to mechanically interlock with at least one second physical feature of the sleeve.

6. The container of claim 1, wherein the lid comprises a third visual indicator configured to indicate an approximate time or date in which the beverage was placed in the container.

7. The container of claim 6, wherein the third visual indicator is configured to be adjusted manually by a user to indicate the approximate time or date in which the beverage was placed in the container.

8. A container for storing a food product comprising:
a vessel for storing the food product, the vessel having an opening at a top of the vessel for insertion or removal of the food product;
a lid; and
a moveable panel attachable to an exterior of the vessel,
wherein:
the moveable panel is moveable between a first position and second position with respect to the vessel,
wherein the first position is closer to the top of the vessel than the second position,
while the moveable panel is in the first position, a first visual indicator is not visible on the vessel, while the moveable panel is in the second position, the first visual indicator configured to indicate a type of food product in the container is visible, and the lid comprises a second visual indicator configured to indicate an approximate time or date in which the food product was placed in the container.

9. The container of claim 8, wherein the moveable panel covers the first visual indicator while the moveable panel is in the first position.

10. The container of claim 8, wherein the moveable panel does not cover the first visual indicator while the moveable panel is in the second position.

11. The container of claim 8, wherein the moveable panel comprises a second visual indicator.

12. The container of claim 8, wherein the second visual indicator is configured to be adjusted manually by a user to indicate the approximate time or date in which the beverage was placed in the container.

13. The container of claim 8, wherein the first visual indicator is on a band that is removable from the container and interchangeable with a different visual indicator on a different band.

14. The container of claim 8, wherein the moveable panel is removable and interchangeable with a different moveable panel.

* * * * *